US009163383B2

(12) United States Patent
Filla

(10) Patent No.: US 9,163,383 B2
(45) Date of Patent: Oct. 20, 2015

(54) METHOD FOR CONTROLLING A POWER SOURCE

(75) Inventor: Reno Filla, Eskilstuna (SE)

(73) Assignee: Volvo Construction Equipment AB, Eskilstuna (SE)

( * ) Notice: Subject to any disclaimer, the term of this patent is extended or adjusted under 35 U.S.C. 154(b) by 524 days.

(21) Appl. No.: 12/990,495

(22) PCT Filed: Jun. 3, 2008

(86) PCT No.: PCT/SE2008/000364
§ 371 (c)(1),
(2), (4) Date: Oct. 30, 2010

(87) PCT Pub. No.: WO2009/148364
PCT Pub. Date: Dec. 10, 2009

(65) Prior Publication Data
US 2011/0087407 A1 Apr. 14, 2011

(51) Int. Cl.

| | |
|---|---|
| ***G06F 7/70*** | (2006.01) |
| ***G06F 19/00*** | (2011.01) |
| ***E02F 9/20*** | (2006.01) |
| ***E02F 9/22*** | (2006.01) |

(52) U.S. Cl.
CPC ..... *E02F 9/2025* (2013.01); *E02F 9/2066* (2013.01); *E02F 9/2246* (2013.01)

(58) Field of Classification Search
USPC ..... 701/1, 50, 54, 70–77, 82–92, 82–9
See application file for complete search history.

(56) References Cited

U.S. PATENT DOCUMENTS

| | | | | | |
|---|---|---|---|---|---|
| 4,869,337 | A | * | 9/1989 | Wagner | 180/330 |
| 5,347,448 | A | * | 9/1994 | Nam | 700/65 |
| 5,590,040 | A | * | 12/1996 | Abe et al. | 701/33.4 |
| 5,775,293 | A | * | 7/1998 | Kresse | 123/396 |
| 5,806,805 | A | * | 9/1998 | Elbert et al. | 244/195 |
| 5,854,988 | A | * | 12/1998 | Davidson et al. | 701/50 |

(Continued)

FOREIGN PATENT DOCUMENTS

| | | |
|---|---|---|
| EP | 1650359 A2 | 4/2006 |
| EP | 1820908 A1 | 8/2007 |

(Continued)

OTHER PUBLICATIONS

International Search Report for corresponding International App. PCT/SE2008/000364.

(Continued)

*Primary Examiner* — Bhavesh V Amin
(74) *Attorney, Agent, or Firm* — WRB-IP LLP

(57) ABSTRACT

A method, an electronic control unit, a vehicle control system and a working machine for controlling an power source adapted to drive at least one ground engaging element of the working machine are provided. The method includes receiving an operator control input indicative of the control of the power source, receiving a state input indicative of an operating state of the machine, determining an operation signal in the response to the operator control input and the operating state input, and sending the determined operation signal for controlling the power source accordingly. An accelerator signal converter adapted to perform any of the method steps is provided, as is an Electronic Control Unit (ECU) including the accelerator signal converter, a vehicle control system including the ECU, and a working machine including the vehicle control system.

29 Claims, 7 Drawing Sheets

(56) References Cited

U.S. PATENT DOCUMENTS

| | | | | |
|---|---|---|---|---|
| 6,061,617 | A * | 5/2000 | Berger et al. | 701/50 |
| 6,062,317 | A * | 5/2000 | Gharsalli et al. | 172/2 |
| 6,076,030 | A * | 6/2000 | Rowe | 701/50 |
| 6,131,062 | A * | 10/2000 | Nielsen | 701/50 |
| 6,138,069 | A | 10/2000 | Ellertson et al. | |
| 6,240,772 | B1 * | 6/2001 | Thomas | 73/114.01 |
| 6,643,577 | B1 * | 11/2003 | Padgett et al. | 701/50 |
| 6,694,240 | B1 * | 2/2004 | Swick et al. | 701/50 |
| 7,027,904 | B2 * | 4/2006 | Ishizu et al. | 701/93 |
| 7,634,863 | B2 * | 12/2009 | Stanek et al. | 37/348 |
| 8,204,662 | B2 * | 6/2012 | Shoemaker | 701/70 |
| 8,321,111 | B2 * | 11/2012 | Ueno et al. | 701/70 |
| 8,352,146 | B2 * | 1/2013 | Doering | 701/96 |
| 2001/0032031 | A1 * | 10/2001 | Ufheil | 700/169 |
| 2003/0051571 | A1 * | 3/2003 | Staker | 74/514 |
| 2006/0167607 | A1 | 7/2006 | Nakamura | |
| 2006/0229786 | A1 | 10/2006 | Sawada | |
| 2006/0276948 | A1 * | 12/2006 | Toda | 701/50 |
| 2007/0145818 | A1 * | 6/2007 | Kobayashi et al. | 303/113.4 |
| 2007/0227137 | A1 | 10/2007 | Naruse | |
| 2008/0133094 | A1 * | 6/2008 | Stanek et al. | 701/50 |
| 2012/0283924 | A1 * | 11/2012 | Shoemaker | 701/70 |

FOREIGN PATENT DOCUMENTS

| | | | |
|---|---|---|---|
| JP | 2002147255 | A2 | 5/2002 |
| WO | 9813557 | A1 | 4/1998 |
| WO | 03089723 | A1 | 10/2003 |

OTHER PUBLICATIONS

International Preliminary Report on Patentability for corresponding International App. PCT/SE2008/000364.

Supp. European Search Report (Feb. 21, 2013) for corresponding European App. EP 08 76 7044.

* cited by examiner

METHOD FOR CONTROLLING A POWER SOURCE

BACKGROUND AND SUMMARY

The invention relates to a method, an accelerator signal converter, an electronic control unit, a vehicle control system and a working machine for controlling a power source adapted to drive at least one ground engaging element of a working machine. The term "power source" is in the following exemplified by an internal combustion engine, such as a diesel engine. This should be regarded as a non-limiting example of such a power source.

Some drivers experience that working machines, such as wheel loaders, are hard to operate. The reason is that the engine in the working machine is used for powering both the hydraulic system and the traction system of the machine. Since the implement of the machine (such as a bucket) acts on a gravel pile or any other object that the machine works with, there will be a strong force coupling via both systems to the engine.

Consequently, the engine will counteract itself since the traction force counteract with the hydraulic forces. The traction force is transmitted to the pile from the engine to the wheels of the machine and further to the ground on which the pile rests. The hydraulic forces are transmitted from the engine to the implement and further to the pile This means that with higher traction force, the lifting force is reduced. In a similar way, the tilt operation by the hydraulic system is counteracted by the traction system.

FIG. 1 illustrates an example. The traction force (Force [kN]) is dependent on the engine speed. When the engine speed is increased, the traction force will as described reduce the effective lift force (LF) and tilt force (BF). The hydraulic force reduction is proportional with the traction force and quadratically proportional with the engine speed (in a driveline with hydrodynamic torque converter). The driver is therefore constantly challenged to balance the hydraulic system and the traction system by controlling the hydraulic levers and the accelerator pedal of the working machine.

Today there are solutions available which reduce the traction, so that the engine speed is limited to avoid that a certain traction force is exceeded. With such a solution the driver will not be able to increase the engine speed over a certain limit. That is, the driver's possibilities to manoeuvre the machine are restricted so that he is not able to decide fully how to operate the machine.

Another phenomena when for instance loading gravel is wheel skidding. When the torque/power, transmitted via the traction systems, exceeds the friction (connection between wheel and ground) the wheel/-s skid. This also influences the maneuvering possibilities for the driver in a negative way.

Furthermore, when the driver drives the machine at a constant speed, the machine may start oscillating. The reason for this is a coupling of accelerator pedal angle to engine speed demand and thus engine speed, and further via engine torque to machine traction force. The normal mapping of the accelerator pedal is a compromise. It may be that this mapping works very well when the driver drives the machine at low speed and low gear. The angle of the accelerator pedal results in a suitable machine speed. However, this mapping may work worse at higher engine speed and especially at a low gear. The high speed may cause the driver's chair to start swing which results in that the drivel's foot and therefore the pedal angle starts changing. The changed angle will inevitably results in a changed engine speed demand, which the engine will fulfil by increasing torque until the higher speed is reached.

In a driveline of the working machine without torque converter or with a torque converter with activated lock-up, the engine's oscillating torque is directly transferred to the wheels and creates an oscillating traction force. In both situations, this will finally result in the negative effect that the whole machine starts oscillating.

It is desirable to solve at least one of the above-mentioned problems by balancing the hydraulic system and the traction system, without restricting the possibility to operate the machine. It is also desirable to avoid oscillations when driving the machine at a high speed and to avoid wheel skidding when for instance loading gravel.

According to an aspect of the present invention a method is provided for controlling an power source adapted to drive at least one ground engaging element of a working machine. The method comprises the step of receiving an operator control input indicative of the control of the power source. What particularly characterizes the method is that it comprises the steps of:

- receiving a state input indicative of an operating state of the machine,
- determining an operation signal in the response to the operator control input and the operating state input,
- sending the determined operation signal for controlling the power source accordingly.

An aspect of the present invention also relates to an accelerator signal converter being adapted to perform any of the method steps according to the method. Furthermore, an aspect of the present invention relates to an Electronic Control Unit (ECU) comprising the accelerator signal converter, a vehicle control system comprising the ECU, and a working machine comprising the vehicle control system.

The main advantage with an aspect of the present invention is that the accelerator signal converter ultimately modifies the relationship between the accelerator pedal angle and the engine speed, which assists the driver when maneuvering the machine. This results in that the balancing of the engine torque between the hydraulic system and the traction system is easier to handle. The mapping can thereby be adapted for particular operating states, which gives the effect that that the engine control unit/entity is able to assist the driver in different working conditions.

Other preferred embodiments and advantages of the invention will emerge from the detailed description below.

BRIEF DESCRIPTION OF THE DRAWINGS

In the following text the invention will be described in detail with reference to the attached drawings. These drawings are used for illustration only and do not in any way limit the scope of the invention.

DETAILED DESCRIPTION

Figure 1:
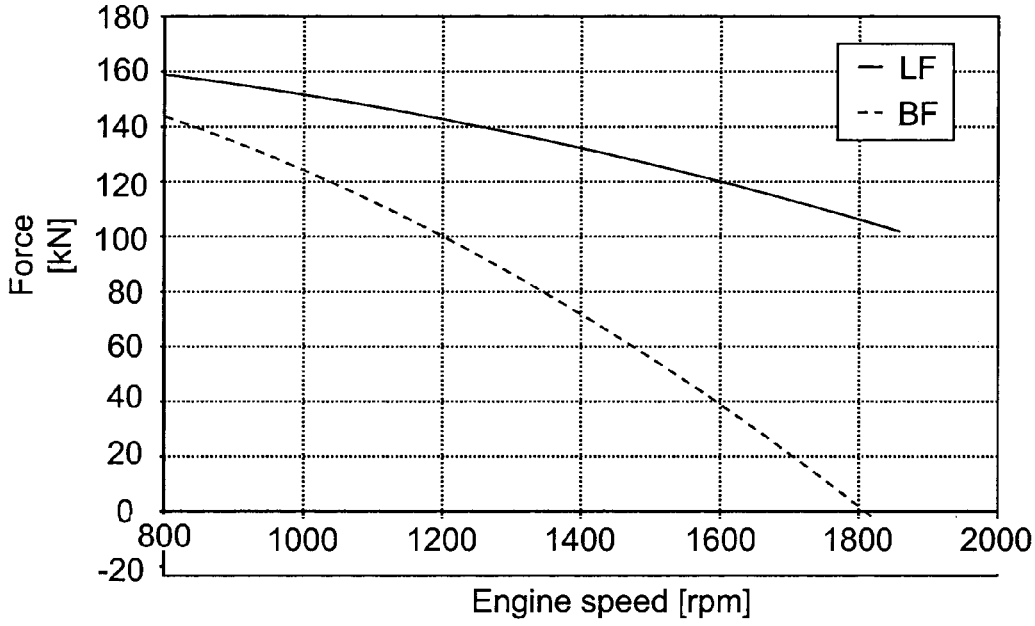
FIG. 1 illustrates the dependency between engine speed and lift- and tilt forces at stalled converter and bucket.

The invention will now be described in detail with reference to embodiments described in the detailed description and shown in the drawings. The embodiments of the invention with further developments described in the following are to be regarded only as examples and are in no way to limit the scope of the protection provided by the patent claims The invention relates to a method, an accelerator signal converter, an accelerator signal converter, an electronic control unit, a vehicle control system and a working machine for controlling a power source adapted to drive at least one ground engaging element of a working machine. The power source will in the following be exemplified by an internal combustion engine.

The accelerator signal converter, the electronic control unit, the vehicle control system and the working machine are adapted for performing the method steps as described in the method according to the embodiments here described. It should therefore be understood by a person skilled in the art that the fact the accelerator signal converter, the control unit, the system and the machine performs the method step means that the method embodiment includes also the converter, the unit, the system and the machine, even though these are not described in detail herein.

Figure 2:
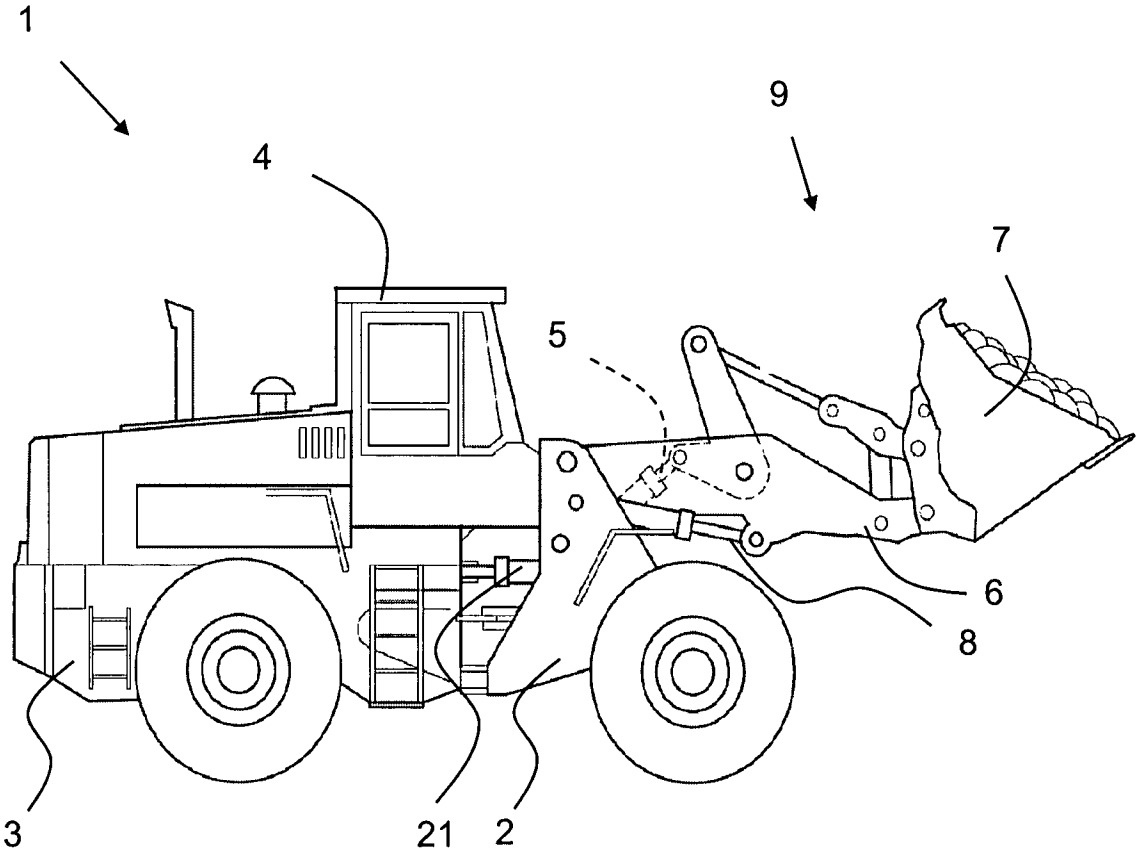
FIG. 2 shows a working machine in the shape of a wheel loader.

FIG. 2 shows a working machine 1 in the form of a wheel loader. The body of the working machine 1 comprises a front body section 2 and a rear body section 3. The rear body section 3 comprises a cab 4. The body sections 2,3 are connected to each other in such a way that they can pivot. A pair of steering cylinders 21 are provided for steering the wheel loader. The working machine 1 comprises equipment 9 for handling objects or material. The equipment 9 comprises a load-arm unit 6 and an implement 7 in the form of a bucket (or fork or log grapple) fitted on the load-arm unit. A first end of the load-arm unit 6 is pivotally connected to the front machine section 2. The implement 7 is connected to a second end of the load-arm unit 6.

The load-arm unit 6 can be raised and lowered relative to the front section 2 of the machine by means of two second actuators in the form of two hydraulic cylinders 8, each of which is connected at one end to the front machine section 2 and at the other end to the load-arm unit 6. The bucket 7 can be tilted relative to the load-arm unit 6 by means of a third actuator in the form of a hydraulic cylinder 5, which is connected at one end to the front machine section 2 and at the other end to the bucket 7 via a link-arm system. The working machine 1 has a drive line that will be described later.

Figure 4:
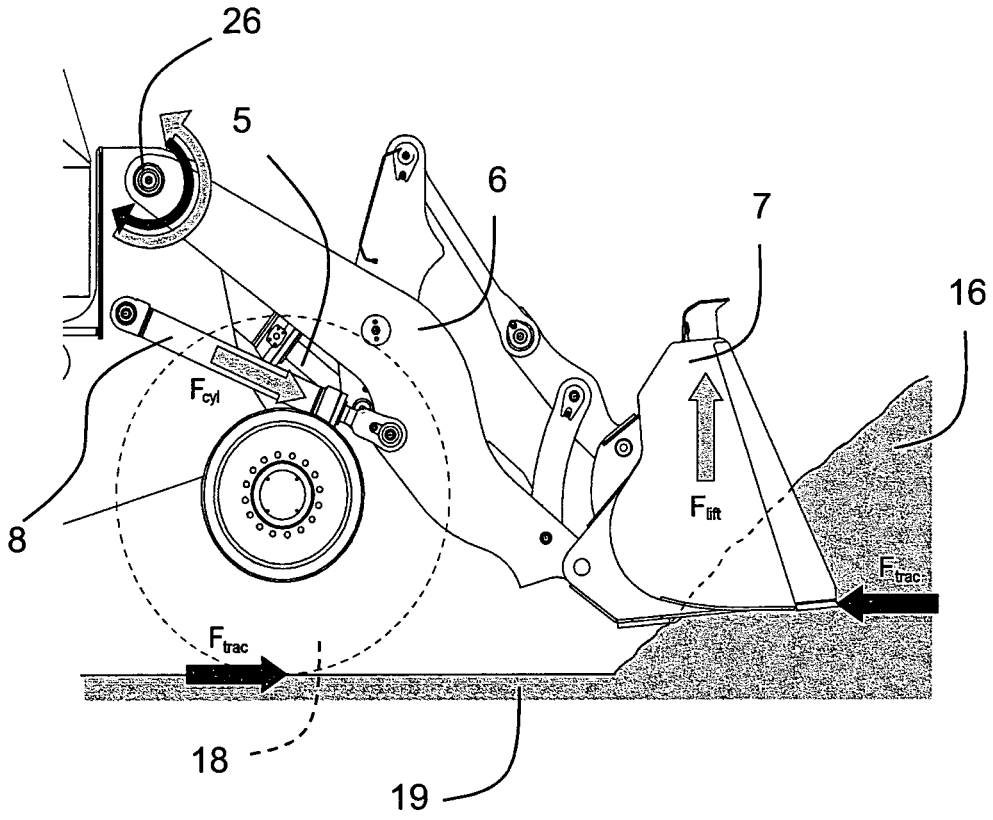
FIG. 4 illustrates how the traction force and the hydraulic lift- and tilt forces act when loading gravel.

FIG. 4 illustrates how the hydraulic system and the traction system are coupled in a working machine, such as a wheel loader. As illustrated, the engine 10 torque/power is fed to both systems via the hydraulic pumps 11 and the torque converter 12.

Figure 3:
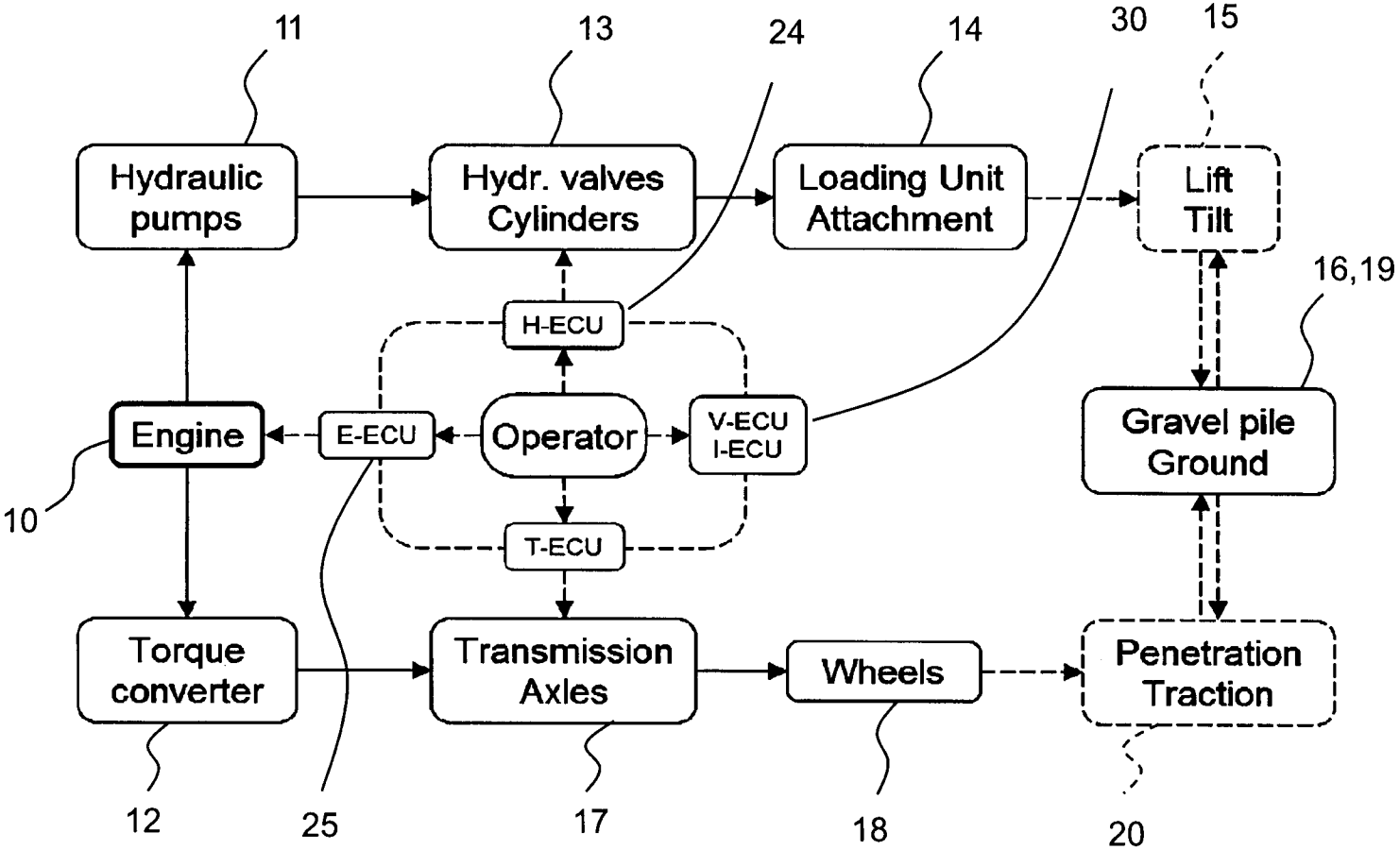
FIG. 3 illustrates how the hydraulic system and the traction system in the wheel loader are coupled via the engine and a gravel pile.

The hydraulic system, see FIG. 3, operates the equipment 9. At least one hydraulic pump 11 driven by the engine 10 via the hydrodynamic torque converter (not shown) supplies the hydraulic cylinders 5,8,21 with hydraulic fluid. A control unit 24 (H-ECU) for controlling the hydraulic system is coupled to a number of electric operator levers arranged in the cab (not shown) to receive electric control input from the levers. A number of electrically controlled hydraulic valves 13 in the system are electrically connected to the control unit 24 and hydraulically connected to the cylinders 5,8,21 for regulating the work of these. The cylinders and the valves are indicated with reference numeral 13 in FIG. 3.

The control unit may also control the pump displacement and speed. When the lever is actuated an electric control input is fed to the unit 24. The input is processed by the unit, and a control signal is fed to control the hydraulic valves and cylinders 13. This results in a movement of the implement. The control signal controls the oil flow via the valves and/or the hydraulic pump 11 (speed or displacement).

The traction system operates the working machine on the ground 19, see FIG. 4. The power from the torque converter 12 is fed via the transmission axles 17 to the wheels 18. Since the wheels acts on the ground through penetration and traction 20, there will be a traction force coupling between the engine 10 and the ground 19. The transmission control unit (T-ECU) for instance controls the transmission course of events.

An engine control unit (E-ECU) 25, see FIG. 3, controls the engine 10 on the basis of an operation signal received by an acceleration signal converter (not shown). The accelerator signal converter is a functionality that converts an operator control input from the acceleration pedal in the operators' cab into the operation signal. The input is received by the accelerator signal converter, which determines the operation signal in form of a set value for the engine speed (in % o or an interval such as 0 to 1).

The operator control input is created when the operator pushes the accelerator pedal. Other means replacing the pedal may also be used, such as a button, lever or touch screen. In case a pedal is used, the signal (current or voltage) depends on the angle of the pivoting pedal.

The accelerator signal converter is not shown as a separate unit in FIG. 3. The converter could be a separate unit or an entity located within another electronic control unit (ECU) within the machine, such as the vehicle ECU 30 (V-ECU) or any other ECU within the machine. The control unit is part of the vehicle control system in the working machine. The vehicle control system relates to all the systems of the working machine, such as the control systems for the traction system and the hydraulic system, see FIG. 3.

The control units in the working machine can be separate units or functionalities (entities) within a common control system for the working machine. In such a case, the functionalities are program codes stored within the system for controlling a certain part of the working machine.

The engine 10 is used for powering both the hydraulic system and the traction system, and there is a strong force coupling via both systems to the engine. This is illustrated in FIG. 4. The lift cylinders 8 create hydraulic forces (Fcyl) when the hydraulic system increases the hydraulic flow in the cylinders. The lift cylinders 8 are linked to the lift arm 6 at a certain distance from the pivoting point 26 of the arm. Thereby a lifting momentum and consequently a lifting force is achieved. The gravel pile, which is influenced by the operated bucket 7, will experience this as an upward directed force (Rift).

The traction force Ftrac originating from the engine 10 and transmitted through the torque converter and the transmission to the axles, is further transmitted to the bucket via the traction force coupling between the wheels 18 and the ground 19. When the bucket is about to be filled with gravel from the pile, the bucket is physically connected to the ground, since the pile is stuck to the ground. Due to this fact, the traction force creates a force between the pile and the bucket, which creates a momentum at the pivoting point 26 of the lifting arm 6, which counteracts with the lifting momentum created by the hydraulic system.

The invention relates to a method for controlling an engine 10 in order to balance the hydraulic and the traction system, without restricting the possibility to operate the machine. The engine is adapted to drive at least one ground engaging element 18 of the working machine 1. The ground engaging element is for instance a wheel 18 or any other means by which the machine is moved in relation to the ground, see FIG. 4. Since the wheels act on the ground through penetration and traction 20, there is a consequently a traction force coupling between the engine and the ground 19.

In the method according to the invention, the engine control unit 25 (E-ECU), see FIG. 3, controls the engine 10 (the power source) in accordance with the operation signal determined by the acceleration signal converter. The method comprises a first step, see FIG. 9, in which the accelerator signal converter receives 30 the operator control input indicative of the control of the engine (the power source) 10.

Figure 9:
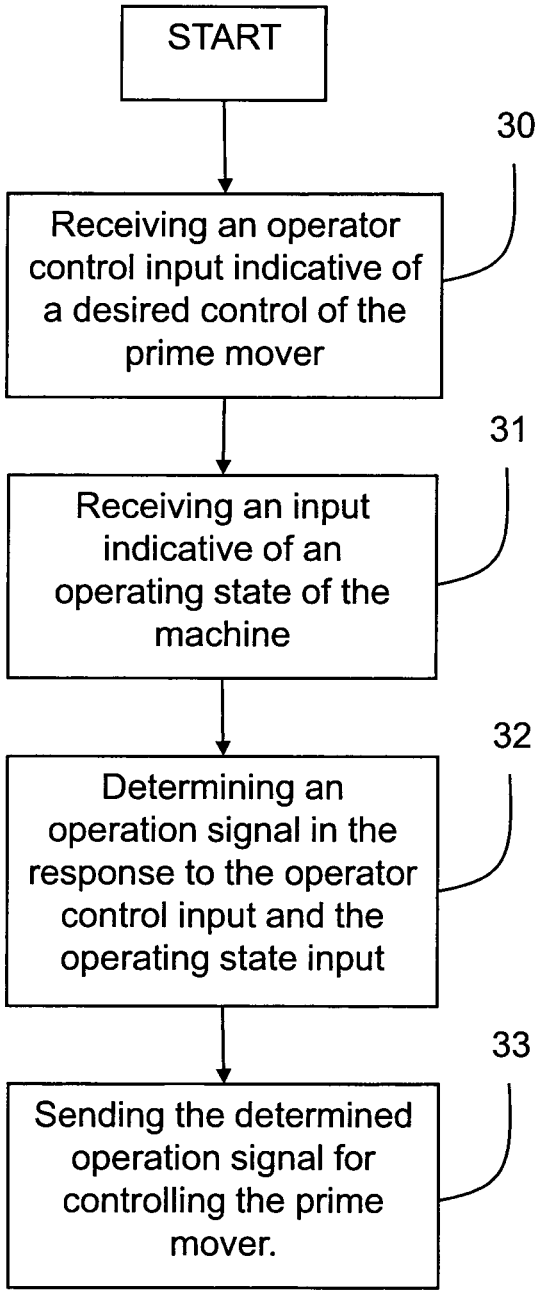
FIG. 9 illustrates the method according to the present invention.

The method according to the present invention is particularly characterized in a second step, see FIG. 9, where the accelerator signal converter receives 31 a state input indicative of the operating state of the machine. In a third step the accelerator signal converter determines 32 the operation signal to the engine control unit 25 in the response to the operator control input and the operating state input. In a fourth step the accelerator signal converter sends 33 the determined operation signal for controlling the engine (the power source) 10 accordingly.

The operation signal may represent at least partly a non-linear relationship between the operator control input and the operation signal. The operation signal may also or as an alternative represent at least partly a linear relationship between the operator control input and the operation signal.

The method may comprise steps of providing at least two operation modes comprising at least one specific control mode. The acceleration signal converter selects one of said operation modes based on the operation state input. The operation signal is then determined is said at least one specific control mode.

The two operation modes may comprise a standard mode representing a default control of the engine (the power source) 10. The standard mode relationship is linear, which means that in the standard mode control map, the angle of the accelerator pedal is proportional with the operation signal controlling of the engine. In case an acceleration pedal is used, the operator control input corresponds to an angle of the acceleration pedal.

An effect of the operation signal may be reduced in a first part of an operation area of the engine (the power source) 10 in relation to the standard mode and increased in a second part of the operation area of the power source in relation to the standard mode.

The method may comprise the steps of providing at least two specific control modes, which comprise different control maps. There may be one control map for each operation state of the machine 1.

Using selectable control maps as shown in FIGS. 5-8 means that a particular operator control input value will result in different operation signal to the engine control unit 25, depending on the selected control map. In other words, the same accelerator pedal angle will result in different engine speed, depending on which map that is currently used by the accelerator signal converter.

In relation to the standard mode relationship between the operator control input and the operation signal, the operation signal is reduced or increased. This means that each selected map is adapted for a particular operating state. The control maps of FIGS. 5-8 provide a temporary re-mapping of the relationship so that the driver is assisted in controlling the accelerator signal to avoid the above-mentioned problems without restricting his ability to decide fully how to operate the machine.

In all control maps, the pedal angle (PA) is on the x-axis while the operation signal (OS) is on the y-axis. The operation signal consists in or comprises a set value for controlling the engine speed. The relationships between the operator control input and the pedal angle is linear. The dotted line in the figures illustrates the standard mode (linear) relationship between the pedal angle and the operation signal. To the left, the x-axis starts at minimal pedal angle, named 0, and ends at a maximal pedal angle, named X. The y-axis starts with 0% and ends with 100%. This means that the operation signal (set value) directly controls the operation level of the engine (the engine speed). The operational area of the system is 0-100%.

Figure 5:
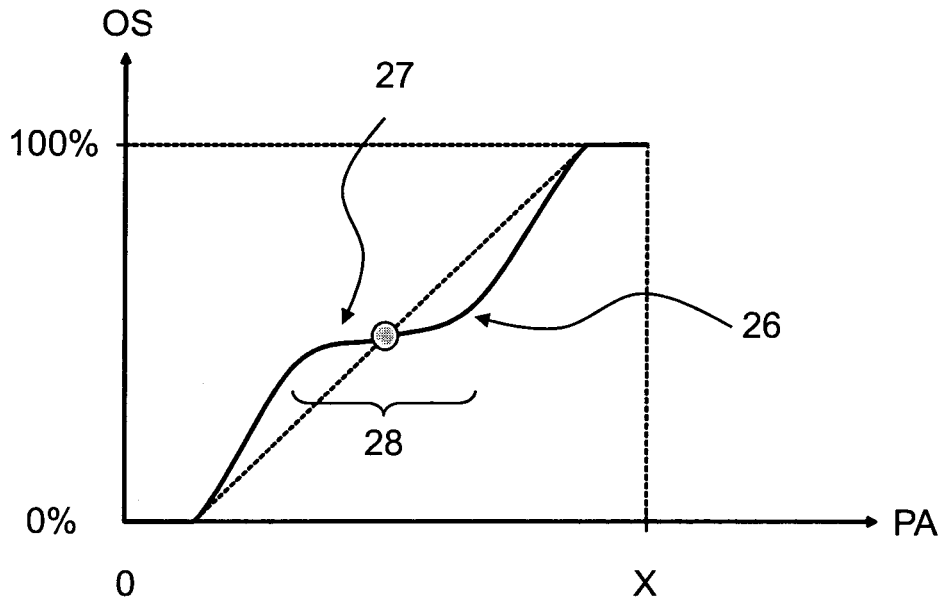
FIG. 5 illustrates the mapping of the relationship between the accelerator pedal angle and the engine speed according to a first embodiment.

According to one of the selectable maps, see FIG. 5, the operation signal is reduced in a first part 26 of the operation area of the engine. Furthermore, it is increased in a second part 27 of the area. The graph line further illustrates that within an interval 28 of the accelerator pedal the operation signal, which is a set value, is kept substantially constant. This control map therefore in a part of the operation area makes the engine speed less sensitive to the angle of the accelerator pedal. If the driver drives the machine at a high constant speed, the swing of the chair will result in that the driver's foot and therefore the pedal angle starts changing. However, this particular control map makes sure that the changed pedal angle will not directly result in a changed engine speed. The pedal angle in such an operation state will normally be within the interval 28. Oscillation is thereby avoided.

Figure 6:
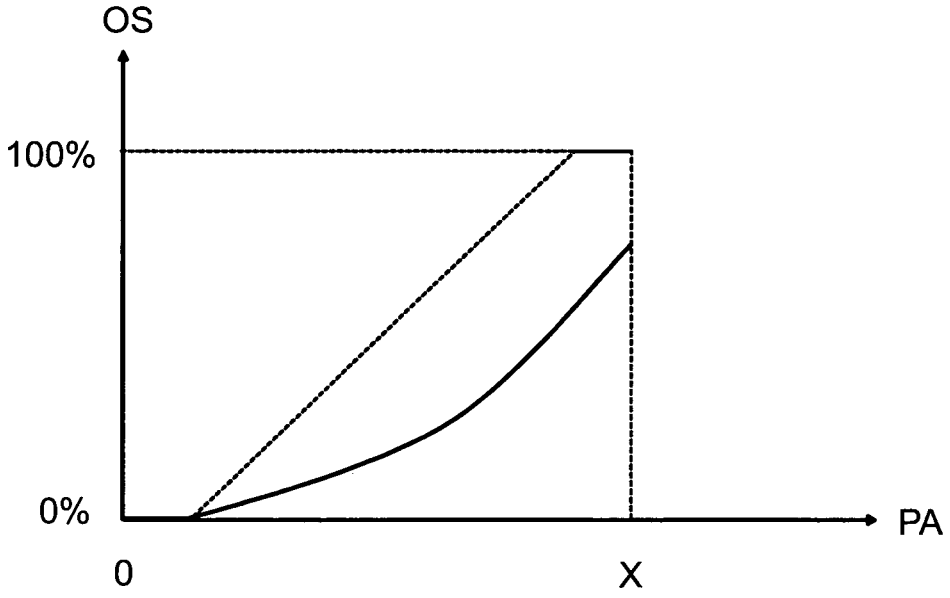
FIG. 6 illustrates the mapping of the relationship between the accelerator pedal angle and the engine speed according to a second embodiment.

The map in FIG. 5 is one example of how an adapted control map can assist the driver in a particular operating state. FIGS. 5-6 shows examples where the non-linear relationship extends over a part of or the entire operation area of the engine 10.

With the control map according to FIG. 6, the driver will be assisted when carefully controlling the accelerator signal in order to balance the hydraulic system and the traction system, see for instance FIG. 3. When actuating the pedal, the engine response will be less instant. The driver can press and release the pedal more freely without having to deal with the direct response from the engine. The traction force can therefore be controlled more easily and for instance gravel loading will more easy to perform. A further benefit is that wheel skidding is avoided. As illustrated, even at maximum pedal angle the operation level of the engine never reaches 100%.

Figure 7:
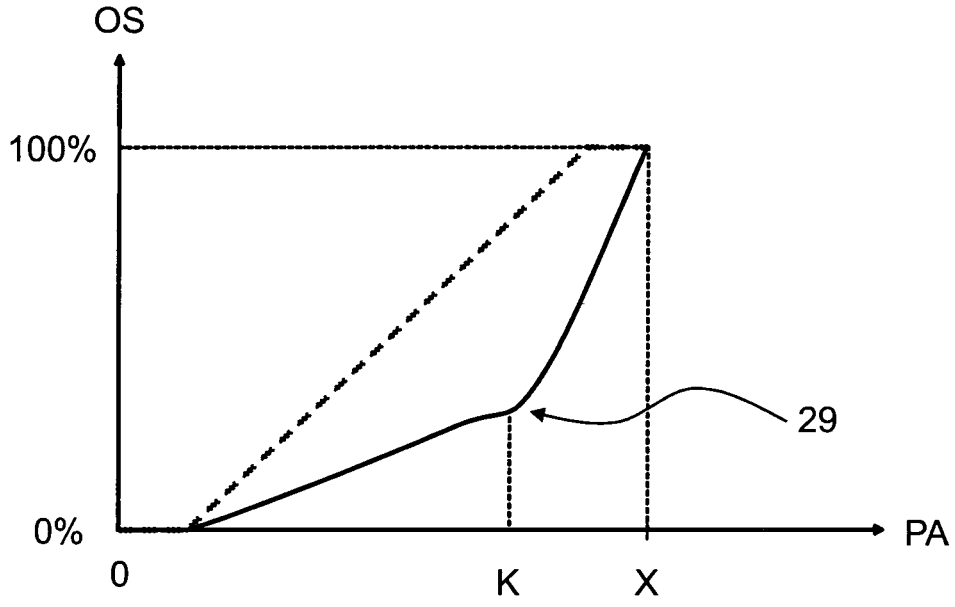
FIG. 7 illustrates the mapping of the relationship between the accelerator pedal angle and the engine speed according to a third embodiment.

With the control map according to FIG. 7, the driver will also be assisted when controlling the accelerator signal for balancing forces and wheel skidding-avoidance purposes. With this map the traction force increase (the engine speed) stops at a certain pedal angle 29. The driver has to "kick-down" (K) the pedal to further increase the traction force. When this is done the traction force increases fast, see FIG. 7. As illustrated, at maximum pedal angle the operation level of the engine reaches 100%. As an alternative, or added to above described solution for "kick-down", the pedal may also be designed so that the kick-down point can actually be experienced by the driver as an increased resistance.

Figure 8:
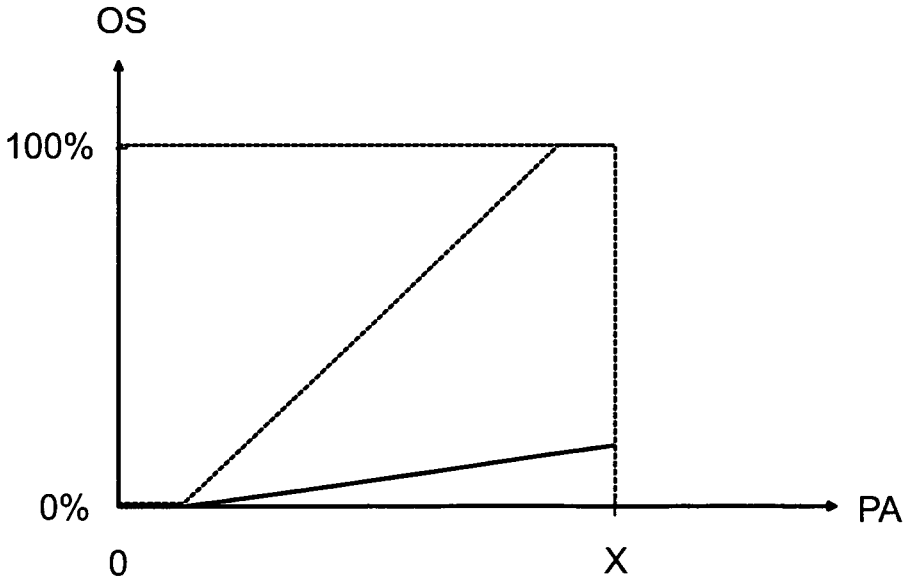
FIG. 8 illustrates the mapping of the relationship between the accelerator pedal angle and the engine speed according to a fourth embodiment.

The map in FIG. 8 is another example of how an adapted control map can assist the driver in a particular operating state. There is a linear relationship that extends over the entire operation area of the engine. The traction force increase is very slow of the entire operational area and even at maximum pedal angle the operation level of the engine is far from reaching 100%. This map is suitable when handling for instance goods.

The state input may be determined by the operators' actuation of a means for selection of different operating states. A manual determination of the operating is for instance achieved by using a manoeuvre button/wheel/lever. Such a system is described in the patent application WO 03089723.

Alternately, the state input may be determined automatically. The operating state may be determined automatically based on at least one detected operational condition. For instance by recognizing patterns for typical measured signals, such as the gear position, the engine power, the hydraulic pressure, the engine speed etc.). As an alternative, the operating state may be determined via the geographical position of the machine (using GPS, gyro or image detection).

The accelerator signal conversion could be performed in a separate accelerator signal converter unit or in an entity located within another electronic control unit within the vehicle control system of the working machine, such as the vehicle ECU 30 (V-ECU) or any other ECU within the machine. The control unit is part of the vehicle control system in the working machine. The person skilled in the art will therefore realise that the present invention comprises any location of the accelerator signal converter within the working machine. The accelerator signal control functionality is therefore defined as an accelerator signal converter.

The power source has above been exemplified by an internal combustion engine. However, also other types of power sources may be used, such as a gas turbine, fuel cell, or a free-piston engine.

The invention claimed is:

1. A method for controlling a speed of a power source adapted to at least one ground engaging element of a working machine, comprising:

receiving an operator control input from an accelerator pedal, the operator control input being indicative of the control of the speed of the power source, receiving a state input indicative of an operating state of the working machine, determining an operation signal in response to the operator control input and the operating state input, the operation signal controlling the speed of the power source, thereby modifying a relationship between an accelerator pedal angle and the speed of the power source in order to assist a driver of the working machine when maneuvering the working machine, and sending the determined operation signal for controlling the speed of the power source accordingly, wherein the operation signal represents at least partly a non-linear relationship between the operator control input and the operation signal.

2. A method for controlling a speed of a power source adapted to drive at least one ground engaging element of a working machine, comprising:

receiving an operator control input from an accelerator pedal, the operator control input being indicative of the control of the speed of the power source, receiving a state input indicative of an operating state of the working machine, determining an operation signal in response to the operator control input and the operating state input, the operation signal controlling the speed of the power source, thereby modifying a relationship between an accelerator pedal angle and the speed of the power source in order to assist a driver of the working machine when maneuvering the working machine, and sending the determined operation signal for controlling the speed of the power source accordingly, wherein the operation signal represents at least partly a linear relationship between the operator control input and the operation signal.

3. A method for controlling a speed of a power source adapted to drive at least one ground engaging element of a working machine, comprising:

receiving an operator control input from an accelerator pedal, the operator control input being indicative of the control of the speed of the power source, receiving a state input indicative of an operating state of the working machine, determining an operation signal in response to the operator control input and the operating state input, the operation signal controlling the speed of the power source, thereby modifying a relationship between an accelerator pedal angle and the speed of the power source in order to assist a driver of the working machine when maneuvering the working machine, sending the determined operation signal for controlling the speed of the power source accordingly, providing at least two operation modes comprising at least one specific control mode and selecting one of operation modes based on the operating state input, wherein the operation signal is determined in at least one specific control mode, wherein at least two operation modes comprises a standard mode representing a default control of the power source, and wherein an effect of the operation signal is reduced in a first part of an operation area of the power source in relation to the standard mode and increased in a second part the operation area of the power source in relation to the standard mode.

4. A method according to claim 1, comprising the steps of providing at least two operation modes comprising at least one specific control mode and selecting one of operation modes based on the operating state input, wherein the operation signal is determine in at least one specific control mode, and providing at least two specific control modes, which comprise different control maps.

5. A method according to claim 4, wherein there is one control map for each operating state of the machine.

6. A method according to claim 1, wherein the operator control input corresponding to an angle of an acceleration pedal.

7. A method according to claim 1, wherein the operating state input is determined by the operators' actuation of a means for selection of different operating states.

8. A method according to claim 1, wherein the state input is determined automatically based on at least one detected operational condition.

9. A method according to claim 1, wherein the power source comprises an internal combustion engine.

10. An accelerator signal converter configured to perform a method for controlling a speed of a power source adapted to drive at least one ground engaging element of a working machine, the method comprising:

receiving an operator control input from an accelerator pedal, the operator control input being indicative of the control of the speed of the power source, receiving a state input indicative of an operating state of the working machine, determining an operation signal in response to the operator control input and the operating state input, the operation signal controlling the speed of the power source, thereby modifying a relationship between an accelerator pedal angle and the speed of the power source in order to assist a driver of the working machine when maneuvering the working machine, and sending the determined operation signal for controlling the speed of the power source accordingly, wherein the operation signal represents at least partly a non-linear relationship between the operator control input and the operation signal.

11. An Electronic Control Unit (ECU) comprising an accelerator signal converter as set forth in claim 10.

12. A vehicle control system comprising an Electronic Control Unit ECU comprising an accelerator signal converter as set forth in claim 10.

13. A working machine comprising a vehicle control system comprising an Electronic Control Unit (ECU) comprising an accelerator signal converter as set forth in claim 10.

14. A method according to claim 2, comprising the steps of providing at least two operation modes comprising at least one specific control mode and selecting one of operation modes based on the operating state input, wherein the operation signal is determine at least one specific control mode, and providing at least two specific control modes, which comprise different control maps.

15. A method according to claim 14, wherein there is one control map for each operating state of the machine.

16. A method according to claim 2, wherein the operator control input corresponding to an angle of an acceleration pedal.

17. A method according to claim 2, wherein the operating state input is determined by the operators' actuation of a means for selection of different operating states.

18. A method according to claim 2, wherein the state input is determined automatically based on at least one detected operational condition.

19. A method according to claim 2, wherein the power source comprises an internal combustion engine.

20. A method according to claim 3, comprising the steps of providing at least two operation modes comprising at least one specific control mode and selecting one of operation modes based on the operating state input, wherein the operation signal is determined in at least one specific control mode, and providing at least two specific control modes, which comprise different control maps.

21. A method according to claim 4, wherein there is one control map for each operating state of the machine.

22. A method according to claim 3, wherein the operator control input corresponding to an angle of an acceleration pedal.

23. A method according to claim 3, wherein the operating, state input is determined by the operators' actuation of a means for selection of different operating states.

24. A method according to claim 3, wherein the state input is determined automatically based on at least one detected operational condition.

25. A method according to claim 3, wherein the power source comprises an internal combustion engine.

26. An accelerator signal converter configured to perform a method for controlling a speed of a power source adapted to drive at least one ground engaging element of a working machine, the method comprising:

receiving an operator control input from an accelerator pedal, the operator control input being indicative of the control of the speed of the power source, receiving a state input indicative of an operating state of the working machine, determining an operation signal in response to the operator control input and the operating state input, the operation signal controlling the speed of the power source, thereby modifying a relationship between an accelerator pedal angle and the speed of the power source in order to assist a driver of the working machine when maneuvering the working machine, and sending the determined operation signal for controlling the speed of the power source accordingly, wherein the operation signal represents at least partly a linear relationship between the operator control input and the operation signal.

27. A working machine comprising a vehicle control system comprising an Electronic Control Unit (ECU) comprising an accelerator signal converter configured to perform a method for controlling a speed of a power source adapted to drive at least one ground engaging element of a working machine, the method comprising:

receiving an operator control input from an accelerator pedal, the operator control input being indicative of the control of the speed of the power source, receiving a state input indicative of an operating state of the working machine, determining an operation signal in response to the operator control input and the operating state input, the operation signal controlling the speed of the power source, thereby modifying a relationship between an accelerator pedal angle and the speed of the power source in order to assist a driver of the working machine when maneuvering the working machine, and sending the determined operation signal for controlling the speed of the power source accordingly, wherein the operation signal represents at least partly a linear relationship between the operator control input and the operation signal.

28. An accelerator signal converter configured to perform a method for controlling a speed of a power source adapted to drive at least one ground engaging element of a working machine, the method comprising:

receiving an operator control input from an accelerator pedal, the operator control input being indicative of the control of the speed of the power source, receiving a state input indicative of an operating state of the working machine, determining an operation signal in response to the operator control input and the operating state input, the operation signal controlling the speed of the power source, thereby modifying a relationship between an accelerator pedal angle and the speed of the power source in order to assist a driver of the working machine when maneuvering the working machine, and sending the determined operation signal for controlling the speed of the power source accordingly, providing at least two operation modes comprising at least one specific control mode and selecting one of operation modes based on the operating state input, wherein the operation signal is determined in at least one specific control mode, wherein at least two operation modes comprises a standard mode representing a default control of the power source, and wherein an effect of the operation signal is reduced in a first part of an operation area of the power source in relation to the standard mode and increased in a second part the operation area of the power source in relation to the standard mode.

29. A working machine comprising a vehicle control system comprising an Electronic Control Unit (ECU) comprising an accelerator signal converter configured to perform a method for controlling a speed of a power source adapted to drive at least one ground engaging element of a working machine, the method comprising:

receiving an operator control input from an accelerator pedal, the operator control input being indicative of the control of the speed of the power source, receiving a state input indicative of an operating state of the working machine, determining an operation signal in response to the operator control input and the operating state input the operation signal controlling the speed of the power source, thereby modifying a relationship between an accelerator pedal angle and the speed of the power source in order to assist a driver of the working machine when maneuvering the working machine, and sending the determined operation signal for controlling the speed of the power source accordingly, providing at least two operation modes comprising at least one specific control mode and selecting one of operation modes based on the operating state input, wherein the operation signal is determined in at least one specific control mode, wherein at least two operation modes comprises a standard mode representing a default control of the power source, and wherein an effect of the operation signal is reduced in a first part of an operation area of the power source in relation to the standard mode and increased in a second part the operation area of the power source in relation to the standard mode.

* * * * *